US011215188B2

(12) United States Patent
Kohen

(10) Patent No.: US 11,215,188 B2
(45) Date of Patent: Jan. 4, 2022

(54) APPARATUS INCLUDING A COMBINATION OF A CEILING FAN AND A HEATER WITH LIGHT EFFECTS

(71) Applicant: SQL Technologies Corp., Pompano Beach, FL (US)

(72) Inventor: Ran Roland Kohen, Aventura, FL (US)

(73) Assignee: SQL Technologies Corp., Pompano Beach, FL (US)

( * ) Notice: Subject to any disclaimer, the term of this patent is extended or adjusted under 35 U.S.C. 154(b) by 457 days.

(21) Appl. No.: 15/515,664

(22) PCT Filed: Sep. 30, 2015

(86) PCT No.: PCT/US2015/053138

§ 371 (c)(1),
(2) Date: Mar. 30, 2017

(87) PCT Pub. No.: WO2016/054159

PCT Pub. Date: Apr. 7, 2016

(65) Prior Publication Data

US 2017/0248148 A1 Aug. 31, 2017

Related U.S. Application Data

(60) Provisional application No. 62/057,565, filed on Sep. 30, 2014.

(51) Int. Cl.
*F04D 25/08* (2006.01)
*F24H 3/04* (2006.01)
(Continued)

(52) U.S. Cl.
CPC ..... *F04D 25/088* (2013.01); *F04D 19/002* (2013.01); *F04D 25/166* (2013.01);
(Continued)

(58) Field of Classification Search
CPC .... F04D 19/002; F04D 25/088; F04D 25/166; F04D 29/005; F04D 29/325; F04D 29/34;
(Continued)

(56) References Cited

U.S. PATENT DOCUMENTS 484,911 A 10/1892 Green
1,595,972 A 8/1926 DeReamer
(Continued)

FOREIGN PATENT DOCUMENTS

CN 1582518 A 2/2005
CN 1728475 A 2/2006
(Continued)

OTHER PUBLICATIONS

International Search Report for PCT/IL99/00499 filed Sep. 14, 1999.

(Continued)

*Primary Examiner* — Ibrahime A Abraham
*Assistant Examiner* — Frederick F Calvetti
(74) *Attorney, Agent, or Firm* — Paul D. Bianco; Gary S. Winer; Fleit Intellectual Property Law

(57) ABSTRACT

A combination assembly or apparatus of a ceiling fan and heater. The combination assembly or apparatus includes a ceiling fan, a heater, a fan to blow air across the heater, a translucent band, motor driven rotating reflective foils each having mounted therein a light source (e.g. an LED) to shine through the translucent band to give a motion effect like a flickering.

20 Claims, 3 Drawing Sheets

(51) Int. Cl.

| | |
|---|---|
| ***F04D 29/58*** | (2006.01) |
| ***F04D 29/00*** | (2006.01) |
| ***F21V 33/00*** | (2006.01) |
| ***F04D 25/16*** | (2006.01) |
| ***F04D 19/00*** | (2006.01) |
| ***F04D 29/32*** | (2006.01) |
| ***F04D 29/34*** | (2006.01) |
| ***F21S 10/04*** | (2006.01) |
| ***F21V 7/22*** | (2018.01) |
| *F21Y 115/10* | (2016.01) |

(52) U.S. Cl.
CPC ..... *F04D 29/005* (2013.01); *F04D 29/325* (2013.01); *F04D 29/34* (2013.01); *F04D 29/582* (2013.01); *F21S 10/046* (2013.01); *F21V 7/22* (2013.01); *F21V 33/0092* (2013.01); *F21V 33/0096* (2013.01); *F24H 3/0411* (2013.01); *F21Y 2115/10* (2016.08)

(58) Field of Classification Search
CPC .. F04D 29/582; F21S 10/046; F21V 33/0092; F21V 33/0096; F21V 7/22; F21Y 2115/10; F21Y 2101/00; F24H 3/0411; F24H 3/04
USPC ..... 392/364
See application file for complete search history.

(56) References Cited

U.S. PATENT DOCUMENTS 1,897,954 A 2/1933 D'Olier
2,077,587 A 4/1937 Rowe
2,308,016 A 1/1943 Mihalyi
2,313,481 A 3/1943 Rendano
2,494,428 A 1/1950 Buck
2,673,966 A 3/1954 Larkin
2,726,372 A 12/1955 Appleton
2,728,895 A 12/1955 Quackenbush
2,863,037 A 12/1958 Johnstone
3,056,035 A 9/1962 Bernheim
3,118,713 A 1/1964 Ellis
3,159,444 A 12/1964 Stine
3,193,636 A 7/1965 Daniels
3,386,071 A 5/1968 Allen
3,398,260 A 8/1968 Martens
3,521,216 A 7/1970 Tolegian
3,585,564 A 6/1971 Skjervoll
3,648,002 A 3/1972 Du Rocher
3,651,443 A 3/1972 Quilez
3,668,603 A 6/1972 Burgess et al.
3,798,584 A 3/1974 Person
3,808,577 A 4/1974 Mathauser
3,813,478 A 5/1974 Ervin
3,855,564 A 12/1974 Dumas
3,871,732 A 3/1975 Appleton
4,059,327 A 11/1977 Vann
4,079,244 A 3/1978 Bortoluzzi
4,083,619 A 4/1978 McCormick et al.
4,107,770 A 8/1978 Weber
4,133,594 A 1/1979 Laverick et al.
4,335,927 A 6/1982 Allen et al.
4,448,388 A 5/1984 Dennis
4,462,653 A 7/1984 Flederbach
4,473,869 A 9/1984 De Widt
4,588,248 A 5/1986 Moore
4,629,843 A 12/1986 Kato et al.
4,631,648 A 12/1986 Nilssen
4,681,385 A 7/1987 Kruger et al.
4,753,600 A 6/1988 Williams
5,003,128 A 3/1991 Grondin
5,034,869 A 7/1991 Choi
5,173,053 A 12/1992 Swanson et al.
5,250,874 A 10/1993 Hall et al.
5,352,122 A 10/1994 Speyer
5,362,122 A 11/1994 Reihl et al.
5,438,216 A 8/1995 Juskey et al.
5,442,532 A * 8/1995 Boulos ..... F21V 23/0442 362/276
5,442,632 A 8/1995 Boulos et al.
5,494,325 A 2/1996 Liu et al.
5,494,326 A 2/1996 Hinds
5,536,685 A 7/1996 Burward-Hoy
5,551,882 A 9/1996 Whiteman
5,562,458 A 10/1996 Stora et al.
5,584,726 A 12/1996 Le Gallic
5,600,537 A 2/1997 Gordin
5,622,873 A 4/1997 Kim et al.
5,668,920 A * 9/1997 Pelonis ..... F04D 25/088 392/361
5,710,541 A 1/1998 Stanley
5,754,408 A 5/1998 Derouiche
5,777,391 A 7/1998 Nakamura et al.
5,790,381 A 8/1998 Derouiche et al.
5,803,590 A 9/1998 Wedell et al.
5,808,556 A 9/1998 Nelson
5,836,781 A 11/1998 Hyzin
5,952,714 A 9/1999 Sano et al.
5,962,810 A 10/1999 Glenn
6,064,155 A 5/2000 Maya
6,068,490 A 5/2000 Salzberg
6,093,029 A 7/2000 Kwon et al.
6,129,598 A 10/2000 Yu et al.
6,135,800 A 10/2000 Majors
6,170,967 B1 1/2001 Usher et al.
6,175,159 B1 1/2001 Sasaki
6,240,247 B1 * 5/2001 Reiker ..... F04D 25/088 392/364
6,241,559 B1 6/2001 Taylor
6,332,794 B1 12/2001 Tzeng Jeng
6,340,790 B1 1/2002 Gordin et al.
6,364,716 B1 4/2002 Seo
6,366,733 B1 * 4/2002 Reiker ..... F04D 25/088 392/364
6,398,392 B2 6/2002 Gordin et al.
6,422,722 B1 7/2002 Voltolina
6,517,223 B2 2/2003 Hsu
6,595,782 B1 7/2003 Hsiao
6,598,990 B2 7/2003 Li
6,631,243 B2 10/2003 Reiker
6,648,488 B1 11/2003 Pearce
6,751,406 B2 6/2004 Reiker
6,793,383 B2 9/2004 Wu
6,821,089 B2 11/2004 Bilskie
6,837,754 B1 1/2005 Walton
6,962,498 B2 11/2005 Kohen
7,052,301 B2 5/2006 Garcia et al.
7,066,739 B2 6/2006 McLeish
7,192,303 B2 3/2007 Kohen
7,462,066 B2 12/2008 Kohen
7,467,881 B2 12/2008 McMillen
7,569,710 B1 8/2009 Ozero
7,706,757 B2 4/2010 Luglio et al.
7,723,862 B1 5/2010 Spillman et al.
7,878,691 B2 2/2011 Liang
8,123,378 B1 * 2/2012 Ruberg ..... F21S 8/088 362/249.02
8,186,852 B2 5/2012 Dassanayake et al.
8,192,057 B2 6/2012 Dassanayake et al.
8,277,082 B2 10/2012 Dassanayake et al.
8,348,678 B2 1/2013 Hardisty
8,354,768 B2 1/2013 Cipriani
8,357,016 B2 1/2013 Schumacher
8,419,218 B2 4/2013 Dassanayake et al.
8,449,137 B2 5/2013 Dassanayake et al.
8,558,413 B1 10/2013 Lepard
D693,765 S 11/2013 Workman
8,702,435 B2 4/2014 Tajima
8,894,247 B2 * 11/2014 Kim ..... F21V 29/505 362/294
8,979,347 B2 * 3/2015 Holman ..... F21V 7/0058 362/613
9,328,910 B2 5/2016 Lin et al.

(56) References Cited

U.S. PATENT DOCUMENTS

| | | | | |
|---|---|---|---|---|
| 9,644,824 | B2 | 5/2017 | Dassanayake et al. | |
| 9,702,535 | B2 | 7/2017 | Dassanayake et al. | |
| 9,901,039 | B1 * | 2/2018 | Dellerson | F21V 23/0435 |
| 9,903,576 | B2 | 2/2018 | Creasman et al. | |
| 10,208,977 | B2 | 2/2019 | Bhide | |
| 10,317,015 | B2 | 6/2019 | Joye | |
| 10,326,247 | B2 | 6/2019 | Kohen | |
| 10,845,046 | B2 | 11/2020 | Kohen | |
| 2002/0060369 | A1 | 5/2002 | Akram | |
| 2002/0064380 | A1 * | 5/2002 | Reiker | F24H 9/2071 392/364 |
| 2002/0081107 | A1 * | 6/2002 | Reiker | F24H 3/0411 392/364 |
| 2003/0012027 | A1 | 1/2003 | Hsu | |
| 2003/0107891 | A1 | 6/2003 | Kohen | |
| 2004/0192415 | A1 | 9/2004 | Luglio et al. | |
| 2005/0148241 | A1 | 7/2005 | Kohen | |
| 2006/0044789 | A1 | 3/2006 | Curtis | |
| 2006/0141842 | A1 | 6/2006 | Sauer | |
| 2006/0146527 | A1 | 7/2006 | Vanderschuit | |
| 2007/0105414 | A1 | 5/2007 | Kohen | |
| 2007/0167072 | A1 | 7/2007 | Kohen | |
| 2007/0258202 | A1 | 11/2007 | Cooley et al. | |
| 2009/0035970 | A1 | 2/2009 | Kohen | |
| 2009/0111322 | A1 | 4/2009 | Roland | |
| 2009/0129974 | A1 * | 5/2009 | McEllen | A61L 9/205 422/24 |
| 2009/0280673 | A1 * | 11/2009 | Kohen | F21V 23/06 439/366 |
| 2010/0020550 | A1 | 1/2010 | Kawashima | |
| 2010/0214775 | A1 | 8/2010 | Liang | |
| 2010/0295473 | A1 * | 11/2010 | Chemel | H05B 47/155 315/294 |
| 2010/0301769 | A1 | 12/2010 | Chemel et al. | |
| 2011/0060701 | A1 | 3/2011 | Verfuerth et al. | |
| 2011/0134239 | A1 | 6/2011 | Vadai et al. | |
| 2012/0196471 | A1 | 8/2012 | Guo | |
| 2013/0040471 | A1 | 2/2013 | Gervais et al. | |
| 2013/0107536 | A1 | 5/2013 | Hiraoka | |
| 2014/0168944 | A1 | 6/2014 | Osada et al. | |
| 2014/0211487 | A1 | 7/2014 | Spiro | |
| 2014/0225731 | A1 | 8/2014 | Gouveia | |
| 2014/0268790 | A1 | 9/2014 | Chobot et al. | |
| 2015/0009666 | A1 * | 1/2015 | Keng | F21V 23/005 362/235 |
| 2015/0009676 | A1 | 1/2015 | Danesh | |
| 2015/0044040 | A1 * | 2/2015 | Oda | F04D 25/08 415/208.1 |
| 2015/0085500 | A1 | 3/2015 | Cooper et al. | |
| 2016/0053952 | A1 | 2/2016 | Kuti et al. | |
| 2016/0069556 | A1 | 3/2016 | Li | |
| 2016/0074574 | A1 * | 3/2016 | Welsch | H01R 35/04 604/152 |
| 2016/0131358 | A1 | 5/2016 | Spiro | |
| 2016/0255697 | A1 | 9/2016 | Bhide | |
| 2017/0105265 | A1 * | 4/2017 | Sadwick | F21K 9/238 |
| 2017/0234319 | A1 * | 8/2017 | Seccareccia | F04D 17/16 415/203 |
| 2017/0248148 | A1 | 8/2017 | Kohen | |
| 2018/0115131 | A1 * | 4/2018 | Kohen | H01R 13/625 |
| 2019/0312396 | A1 * | 10/2019 | Kohen | H01R 13/6658 |
| 2020/0018469 | A1 * | 1/2020 | Kohen | F21V 21/002 |
| 2020/0056773 | A1 * | 2/2020 | Kohen | H01R 13/6276 |
| 2020/0144766 | A1 * | 5/2020 | Kohen | H01R 13/6276 |

FOREIGN PATENT DOCUMENTS

| | | | |
|---|---|---|---|
| CN | ZL 01 8 23877.7 | | 11/2007 |
| CN | 10195268 | A | 12/2007 |
| CN | 101095268 | A | 12/2007 |
| CN | 102483213 | A | 5/2012 |
| CN | 102870307 | A | 1/2013 |
| CN | 104033399 | * | 9/2014 |
| CN | 104033399 | A | 9/2014 |
| CN | 203934061 | U | 11/2014 |
| CN | 204879746 | U | 12/2015 |
| CN | 105674223 | A | 6/2016 |
| CN | 107211515 | A | 9/2017 |
| DE | 19849101 | A1 | 4/1999 |
| DE | 29923352 | U1 | 8/2000 |
| DE | 20203467 | U1 | 6/2002 |
| EP | 0704934 | A2 | 4/1996 |
| EP | 1024559 | A2 | 8/2000 |
| EP | 1456914 | A1 | 9/2004 |
| EP | 1789984 | A2 | 5/2007 |
| EP | 3295525 | A1 | 5/2016 |
| IL | 126246 | | 8/2001 |
| JP | 2008166071 | A | 7/2008 |
| JP | 53311043 | B2 | 10/2013 |
| RU | 2011122686 | | 10/2012 |
| RU | 2526853 | | 8/2014 |
| WO | 00/16442 | | 3/2000 |
| WO | 01/01047 | A1 | 1/2001 |
| WO | 03/044906 | A1 | 5/2003 |
| WO | 2005053100 | A2 | 6/2005 |
| WO | 2005/074087 | A1 | 8/2005 |
| WO | 2006031853 | A2 | 3/2006 |
| WO | 2006/060772 | A2 | 6/2006 |
| WO | 2006060772 | A2 | 6/2006 |
| WO | 2011/005526 | A2 | 1/2011 |
| WO | 2011/020231 | A1 | 2/2011 |
| WO | 2011/134709 | A2 | 3/2011 |
| WO | 2011/134709 | A2 | 11/2011 |
| WO | 2012/167320 | A1 | 12/2012 |
| WO | 2016054159 | A1 | 4/2016 |
| WO | 2016/144795 | A1 | 9/2016 |
| WO | 2016/183354 | | 11/2016 |
| WO | 2016/183354 | A1 | 11/2016 |
| WO | 2016183354 | A1 | 11/2016 |
| WO | 2018/165646 | | 9/2018 |
| WO | 2018/165058 | | 10/2018 |
| WO | 2018/195068 | | 10/2018 |

OTHER PUBLICATIONS

European Search Report for EP 01 27 4757 dated Mar. 28, 2006.

Australian Examiner's First Report on Patent Application AU 2002221000.

Indian First Examination Report dated Jun. 24, 2010 for Indian Application No. 1677/KOLNP/2006.

New Zealand Examination Report for NZ Patent Application No. 533697 dated May 9, 2007.

For Chinese Patent Application No. 01823877.7: Notice of Allowance dated Oct. 17, 2006 Second Office Action dated Apr. 6, 2007 First Office Action dated Jul. 4, 2006.

International Search Report with Written Opinion dated Jul. 6, 2018 for PCT/US2018/027956.

Office Action dated Sep. 18, 2018 in U.S. Appl. No. 15/573,606.

Chinese Search Report dated Feb. 18, 2019 for Patent Application No. 2016800404661.

First Office Action dated Feb. 27, 2019 from Chinese Patent Office for Patent Application No. 201680040466.1.

International Search Report dated Jul. 18, 2016 for International Application No. PCT/US2016/032170 filed May 12, 2016.

Written Opinion for for International Application No. PCT/US2016/032170 filed May 12, 2016.

International Search Report and Written Opinion for PCT/US2018/21919 filed Mar. 12, 2018.

International Search Report and Written Opinion for PCT/US2018/20987 filed Mar. 5, 2018.

European Search Report dated Jul. 3, 2018 for Application No. 15846948.6-1004/3212939.

International Search Report, Written Opinion, International Preliminary Report on Patentability for PCT/US2004/039399 filed Nov. 22, 2004.

International Search Report, Written Opinion, International Preliminary Report on Patentability for PCT/US2005/032661 filed Sep. 14, 2005.

(56) References Cited

OTHER PUBLICATIONS

International Search Report, Written Opinion, International Preliminary Report on Patentability for PCT/US2005/043934 filed Dec. 2, 2005.
International Search Report, Written Opinion, International Preliminary Report on Patentability for PCT/US2015/53138 filed Sep. 30, 2015.
International Search Report and Written Opinion for PCT/US2016/32170 filed May 12, 2016.
European Search Report for EP05796234 dated Nov. 5, 2007 (realted to WO2006031853).
International Search Report for PCT/IL01/01078 filed Nov. 22, 2001.
Second Office Action for Chinese Patent Application No. 201580063483.2, dated Jun. 14, 2019 (with translation of cover page).
Response filed Jan. 17, 2019, in U.S. Appl. No. 15/573,606.
European Search Report for Application No. 16793548.5 dated Feb. 14, 2019.
International Preliminary Report on Patentability dated Nov. 14, 2017 for International Application No. PCT/US2016/032170 filed May 12, 2016.
Publication issued in the Official Gazette from Mexican Patent Application MX/a/2017/004137 dated Feb. 13, 2018, 3 pages.
English translation of Search Report from Chinese Patent Office for Application No. 201580063483.2 dated Sep. 11, 2018.
English translation of Office Action from Chinese Patent Office for Application No. 201580063483.2 dated Sep. 25, 2018.
IAEI, When continuity snaps, May-Jun. 2015.
IAEI, Supports reinforce our safety, Hanging Support Systems, Mar.-Apr. 2015.
International Search Report with Written Opinion dated Aug. 13, 2018 for PCT/US2018/030372.
Office Action dated Sep. 25, 2014 from Chinese Patent Office for Application No. 201580063483.2.
International Search Report dated May 25, 2020 for PCT/US2020/019010 filed Feb. 20, 2020.
Written Opinion dated May 25, 2020 for PCT/US2020/019010 filed Feb. 20, 2020.
First Office Action dated Sep. 2, 2020 for Chinese Application No. 201880030051.5 with translation of cover page (12 pages).
Response to First Examination Report, filed Sep. 4, 2020 for Indian Patent Application No. 201717013438, National Stage of PCT/US2015/053138.
Office Action dated Aug. 3, 2020, for European Patent Application No. 16793548.5 (Regional Stage of PCT/US2016/032170).
Office Action for U.S. Appl. No. 16/443,207, dated Mar. 11, 2020.
For Russian Patent Application 2017142137 (national Stage of PCT/US2016/032170): Prosecution history including decision to grant dated Oct. 25, 2019.
Office Action issued by the European Patent Office dated Dec. 19, 2019 for Application No. 16 793 548.5-1201.
International Preliminary Report on Patentability dated Nov. 5, 2019 for International Application No. PCT/US2018/030372 filed May 1, 2018, 6 pages.
Written Opinion for International Application No. PCT/US2018/030372 filed May 1, 2018, 5 pages.
For Chinese Patent Application No. 201580063483.2 (national stage of PCT/US2015/053138) Third Office Action, dated Sep. 18, 2019 (with English translation): Response to Third Office Action, dated Dec. 2, 2019 (13 pages).
For Chinese Patent Application No. 201580063483.2 (national stage of PCT/US2015/053138): Response to First Office Action, dated Feb. 11, 2019 (9 pages) Response to Second Office Action, dated Aug. 26, 2019 (12 pages).
For Chinese Patent Application No. 2016800404661 (national stage of PCT/US2016/032170): Second Office Action, dated Dec. 2, 2019 (3 pages) Search Report, dated Nov. 24, 2019 (2 pages).
For Indian Patent Application No. 201717013438 (National Stage of PCT/US2015/053138): First Examination Report, dated Dec. 13, 2019 (6 pages).
European Search Report dated Oct. 21, 2020 for EP 18764255.8.
For Brazilian Patent Application No. BR 11 2017 024224-9 (National Stage of PCT/US2016/032170): Response filed Oct. 14, 2020.
For U.S. Appl. No. 16/605,994: Notice of Allowance dated Jun. 29, 2020.
First Examination Report dated Jun. 2, 2020 for Indian Patent No. 201717042509 filed Nov. 27, 2017.
Office Action for U.S. Appl. No. 16/491,321, dated Apr. 21, 2020.
Office Action for U.S. Appl. No. 15/515,664, dated Sep. 10, 2019.
International Preliminary Report on Patentability dated Sep. 10, 2019 for PCT/US2018/020987, filed Mar. 5, 2018.
International Search Report dated Jul. 6, 2018 for PCT/US2018/027956 filed Apr. 17, 2018.
Written Opinion dated Jul. 6, 2018 for PCT/US2018/027956 filed Apr. 17, 2018.
International Search Report dated May 17, 2018 for PCT/US2018/021919 filed Mar. 12, 2018.
Witten Opinion for PCT/US2018/021919 filed Mar. 12, 2018.
International Preliminary Report on Patentability dated Sep. 10, 2019 for PCT/US2018/021919.
International Search Report dated Aug. 13, 2018 for PCT/US2018/030372 filed May 1, 2018.
Written Opinion dated Aug. 13, 2018 for PCT/US2018/030372 filed May 1, 2018.
International Preliminary Report on Patentability dated Oct. 22, 2019 for PCT/US2018/027956.
First Office Action dated Aug. 13, 2020 for Chinese Application No. 2018800295358.
Search Report dated Aug. 7, 2020 for Chinese Application No. 2018800295358.
Notice of Allowance dated Jul. 8, 2020 for U.S. Appl. No. 16/609,875.
Notice of Allowance dated Feb. 2, 2021 for U.S. Appl. No. 16/443,207.
First Notification of Office Action dated Nov. 19, 2020, for Chinese Application No. 2018800333913, National Stage of PCT/US2018/027956 10 pages (with partial English translation).
First Office Action dated Dec. 23, 2020, for Israeli Patent Application No. 255549, National Stage of PCT/US2016/32170 7 pages.
First Office Action dated Oct. 23, 2020 for Chinese Application No. 2018800402400.

* cited by examiner

APPARATUS INCLUDING A COMBINATION OF A CEILING FAN AND A HEATER WITH LIGHT EFFECTS

FIELD OF THE DISCLOSURE

The disclosure relates to a combination assembly or apparatus of a ceiling fan and heater. The disclosure also relates to a combination assembly or apparatus of a ceiling fan, a heater, a fan to blow air across the heater, a translucent band, motor driven rotating reflective foils each having mounted therein a light source (e.g. an LED) to shine through the translucent band to give a motion effect like a flickering.

BACKGROUND

Ceiling fans are commonly utilized to assist in ventilation and circulation of air. Many different forms of ceiling fans with a plurality of blades driven by an electric motor suspended from the ceiling are commercially available on the market. The operation of the motor causes the blades to rotate about a vertical axis usually forcing air in a downward direction. Some ceiling fans have reversible motors so that the blades can rotate in a direction that forces air in an upward direction.

Switches are used to control the ceiling fan. Also it is known to support housings for light bulbs on the housing associated with the ceiling fan. Light kits for ceiling fans are well known and typically include one to five incandescent or halogen light sources. Fluorescent light sources have also been disclosed for use with ceiling fans. Operation of ceiling fans is usually for the purpose of ventilation and/or circulation of air. The main function of a ceiling fan is to merely move air within a room without adding heat to the air which passes the fan.

While ceiling fans are used almost exclusively under warm conditions, they are also of potential value in cool and cold weather, when enclosed spaces must be heated. Since hot air rises, rooms tend to be heated from the top down, lengthening the discomfort endured by their occupants from the cold, particularly when ceilings are high. This is also wasteful of energy, because the upper portion of a room is not occupied. As ceiling fans tend to bring air close to the ceiling of a room down towards the center of the room, ceiling fans can increase the comfort of occupants of cold rooms while they are being heated through their circulation of the room's air, and reduce energy costs. On the other hand, the slight draft they create, so pleasant on a sultry day, may have the opposite effect on a cold one.

It is also known to have the fan air blown through a heater, so that the fan air is heated. The disclosure relates to an improved combination assembly of a ceiling fan and heater, which in some embodiments includes lighting effects.

SUMMARY OF THE DISCLOSURE

An apparatus for distributing heated air to a room environment comprises: a ceiling fan assembly having a main housing composed of a ceiling mounting portion housing, an upper housing portion, a rotating housing portion from which a plurality of fan blades extend in a horizontal plane to create a downward air flow, and a lower housing portion, with the housing portions structurally interconnected internally of the main housing and electrical wires extending from the top of the ceiling mounting portion centrally through the main housing. The apparatus also includes a ceiling fan motor for rotating the rotating housing portion, a heater mounted at the bottom of the lower housing portion, a skirt enclosing at least a portion of the heater, and a heating fan driven by a heating fan motor mounted within the lower housing to pass air over the heater. The heated air output from the heater mixes with the downward air flow from the plurality of fan blades to distribute heat and air circulation in a room environment.

The apparatus can include a translucent band surrounding the lower housing portion in a horizontal plane between the fan blades and the heater, a plurality of reflective foils mounted for rotation in the main housing in the lower housing portion in the horizontal plane, and lighting elements mounted with the reflective foils to shine light through the translucent band. A spin motor can be included for rotating the plurality of reflective foils. In one embodiment, each of the plurality of reflective foils radially extending from the spin motor on a corresponding one of a plurality of spokes.

The apparatus can include a quick attachable-detachable device having a plug and mating socket, wherein the plug is secured to the ceiling mounting portion housing. Furthermore for coupling the heater to the lower housing portion, a second quick attachable-detachable device having a plug and mating socket can be included, with the plug secured to the heater and the mating socket secured to the bottom of the lower housing portion.

In some embodiments, the lighting elements are LEDs. In some embodiments, the heater is a ceramic heater. In some embodiments, the plurality of blades are detachably connected to the rotating housing portion. In some embodiments, the heater and heating fan motor are only operable when the ceiling fan motor is operating.

BRIEF DESCRIPTION OF THE DRAWINGS

A more complete understanding of the present disclosure, and the attendant advantages and features thereof, will be more readily understood by reference to the following detailed description when considered in conjunction with the accompanying drawings wherein.

DETAILED DESCRIPTION

As required, embodiments are disclosed herein; however, it is to be understood that the disclosed embodiments are merely examples and that the systems and methods described below can be embodied in various forms. Therefore, specific structural and functional details disclosed herein are not to be interpreted as limiting, but merely as a representative basis for teaching one skilled in the art to variously employ the present subject matter in virtually any appropriately detailed structure and function. Further, the terms and phrases used herein are not intended to be limiting, but rather, to provide an understandable description of the concepts.

The terms "a" or "an", as used herein, are defined as one or more than one. The term plurality, as used herein, is defined as two or more than two. The term another, as used herein, is defined as at least a second or more. The terms "including" and "having," as used herein, are defined as comprising (i.e., open language). The term "coupled," as used herein, is defined as "connected," although not necessarily directly, and not necessarily mechanically.

Figure 1:
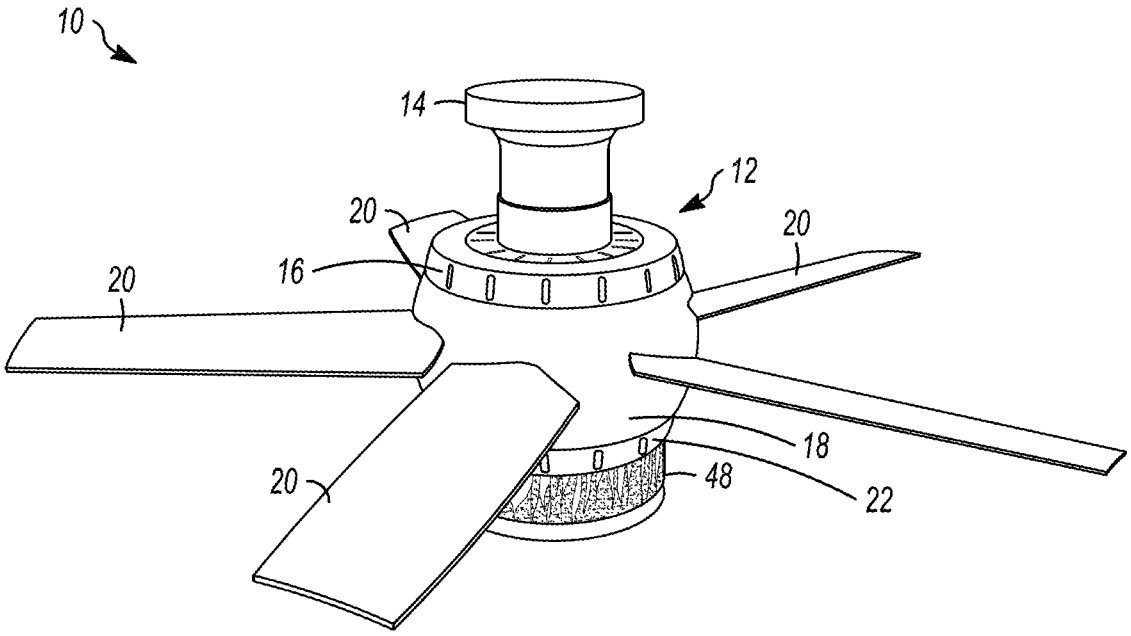
FIG. 1 shows a perspective view as seen looking slightly downwardly of one embodiment of the assembly or apparatus according to the disclosure.
Figure 2:
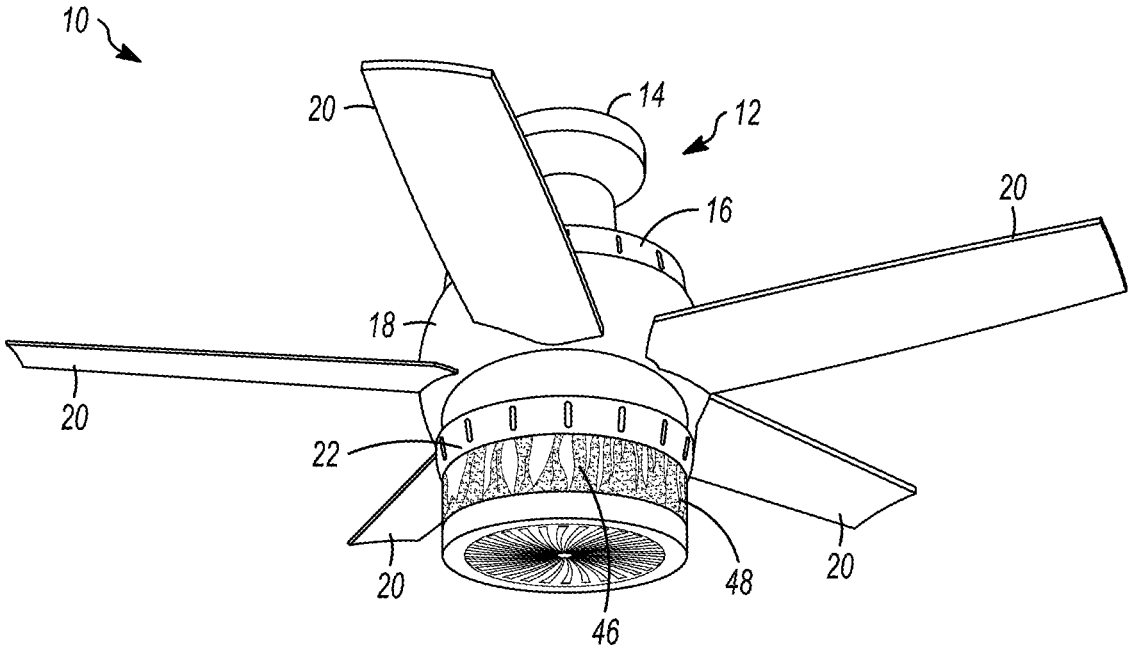
FIG. 2 shows a perspective view as seen looking slightly upwardly of the assembly or apparatus of FIG. 1.
Figure 3:
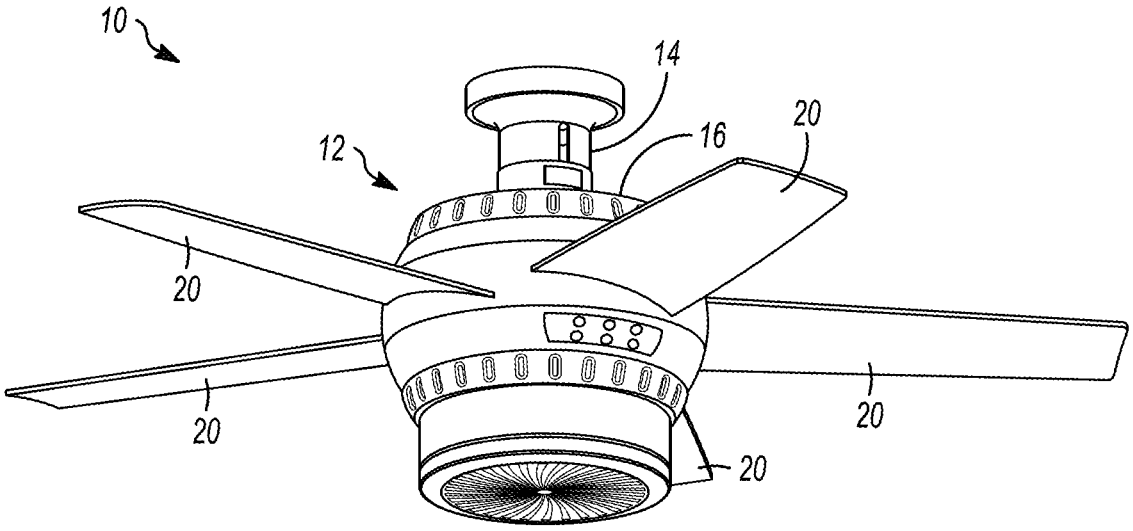
FIG. 3 shows a larger perspective view as seen looking slightly upwardly of the assembly or apparatus of FIG. 1 with no lighting effect.

Referring now to the drawings, a specific embodiment of the assembly or apparatus 10 according to the disclosure is shown schematically in FIGS. 1-4. As seen in FIGS. 1-3, the assembly or apparatus 10 comprises a main housing 12 composed of a ceiling mounting portion housing 14, an upper housing portion 16, a rotating housing portion 18 from which a plurality of fan blades 20 extend radially outward, and a lower housing portion 22. Although five fan blades 20 are shown, any suitable number of fan blades 20 can be used and the fan blades 20 can be integral to rotating housing portion 18 or attached to rotating housing portion 18 so as to be replaceable. Regardless of the number of fan blades 20, the fan blades can extend substantially horizontally (i.e. parallel to a ceiling that has no angle relative to the floor) or be angled relative to the ceiling.

The various housing portions 14, 16, 18, and 22 are structurally interconnected internally of the main housing 12 and for aesthetics electrical wires and cables preferably extend from the top of the ceiling mounting portion centrally through the main housing. As this structure can take many forms, it will be apparent to those skilled in the art how the interconnections are centrally made and how the wiring and cabling takes place, therefore these details are omitted for sake of clarity.

Figure 4:
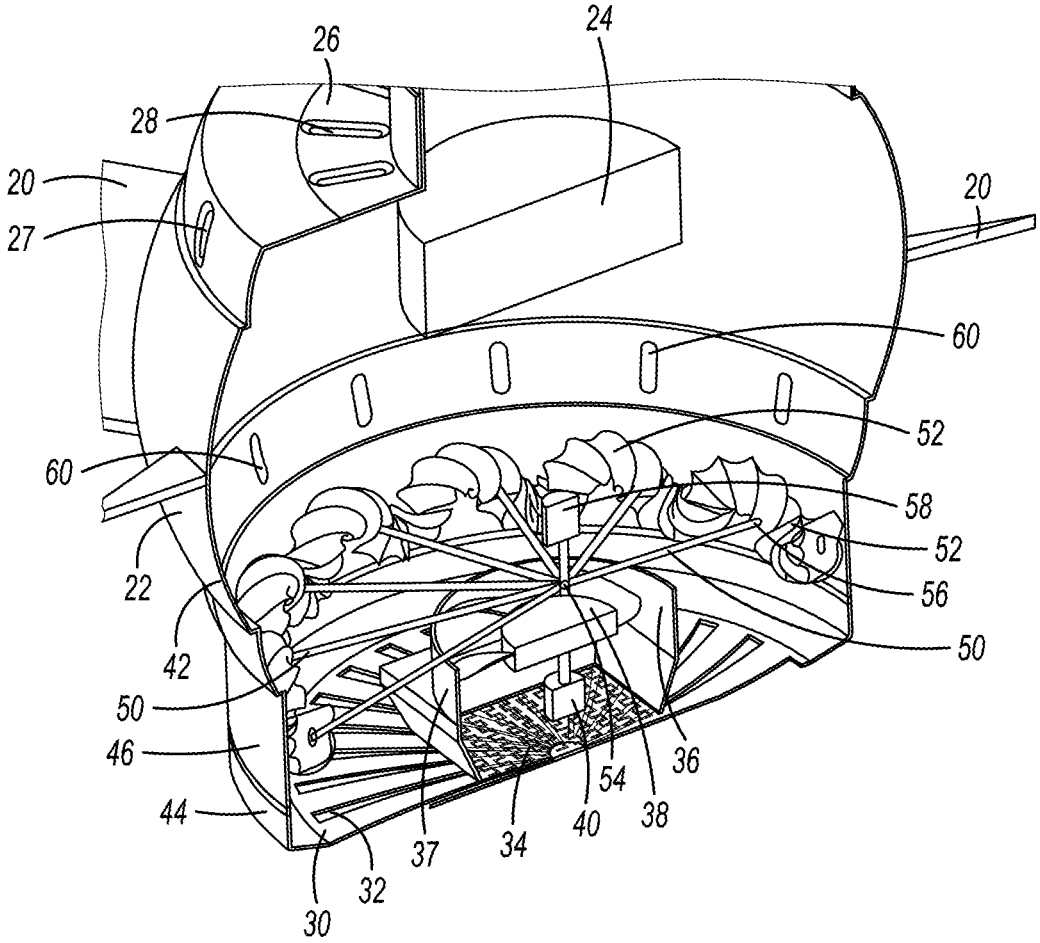
FIG. 4 shows a partially cutaway longitudinal view structure through its mid-axial plane showing schematically the components of the assembly or apparatus of FIG. 1.

A ceiling fan motor 24 is shown schematically in FIG. 4 mounted in the main housing within the upper housing portion 16 and rotating housing portion 18 and its output shaft (not shown) is engaged, for example, via suitable gearing (not shown) with a ring gear (not shown) fixed to the rotating housing portion 18, so that operation of ceiling fan motor 24 causes rotating housing portion 18 with fixed fan blades 20 to rotate, in turn causing a circular air flow to be directed downwardly. In embodiments in which ceiling fan motor 24 is reversible, the circular air flow can be directed upwardly. Rotating housing portion 18 is supported in a known manner by suitable bearing surfaces (not shown) provided by upper housing portion 16 and lower housing portion 22. A grill 26, having radial slots 28, forms the top of the upper housing portion 16. Upper housing 16 has longitudinal slots 27 peripherally spaced to enable air to enter the upper housing 16. Radial slots 28 and longitudinal slots 27 enable air to enter the main housing above the ceiling fan motor 24 for cooling of the motor and then passage into the lower housing 22. Any combination and configuration of radial slots 28 and longitudinal slots 27 that enable sufficient air entry is contemplated by the disclosure.

The bottom of the lower housing portion 22 is closed off by a grill 30, having radial slots 32. Any suitable number of slots 32 in any suitable shape other than radial is contemplated by the disclosure. The central portion of grill 30 is cutout and a heating element such as a ceramic heater or heating coil 34 is fitted into the cutout. Wiring (not shown) extending from the top of the main housing 12 is connected to power the ceramic heater 34. Skirt or circular structure 36, of substantially the same diameter as or slightly larger than the ceramic heater 34 is mounted above the ceramic heater 34 to form an air tunnel. Within the circular structure 36 is mounted a heating fan 38 driven by a heating fan motor 40, also powered by wiring (not shown) extending from the top of the main housing 12. It should be noted that ceramic heater 34 and heating fan motor 40 can be electrically connected so that ceramic heater 34 and heating fan motor 40 can be switched on or off independent of ceiling fan motor 24. Alternatively, ceramic heater 34 and heating fan motor 40 can be electrically connected so that ceramic heater 34 and heating fan motor 40 can be switched on (or off) only when ceiling fan motor 24 is running.

In operation, the ceramic heater 34 heats air that enters the air tunnel and is blown over the ceramic heater 34 by the heating fan 38. Like the air flow output of the blades 20, the heated air flow output by the ceramic heater 34 is directed downwardly. When both the ceiling fan blades 20 and ceramic heater 34 are functioning, the heated air from the ceramic heater flows downwardly conically expanding outwardly due to diffusion and mixes with the flow of air from the ceiling fan blades 20. When the mixed flow reached the floor of the room in which the ceiling fan is mounted, the air flow spreads outwardly until it encounters the walls whereupon it will rise upwardly toward the ceiling.

Referring to FIG. 4, the lower housing portion 22 is spherically shaped at its upper part 42 and terminates at its lower part 44 in a cylindrical shape. A part of the cylindrical shape is composed of a translucent band 46 that can have axially colored striping 48 on its face, see FIGS. 1 and 2. The lower housing portion above the translucent band 46 is cutout with peripherally spaced, longitudinally extending (or other shaped) slots 60 to enable air to enter the lower housing portion 22 and supply the ceramic heater 34 via the air tunnel. Within the lower housing portion 22, above the ceramic heater 34, is mounted a series of spokes 50 connected together at one end 54 along the axis of the main housing 12 and extend radially (or transversely) toward the translucent band 46. At the radial outer end 56 of each spoke is mounted a reflective foil 52 that acts as a reflector for a light source, which can be the light generated by the ceramic heater or another light such, such as LEDs 37 or other lighting element. The LEDs can be mounted on the end or any part of the spokes or foils or spaced a distance from the foils. The spokes are mounted for rotary motion, and the LEDs are powered by wiring extending from the top of the main housing in any known way. The rotary motion is achieved by a reflective foil spin motor 58 mounted above the spokes, so that the light shines through the translucent band 46 and is viewed on the exterior as a flame flickering due to the striping 48.

The main housing is intended to be mounted to a ceiling via a junction box using convention techniques or a quick attachable-detachable assembly as previously disclosed. This disclosure of the quick attachable-detachable assembly is found in U.S. Pat. No. 7,462,066 filed Mar. 20, 2007; U.S. Pat. No. 7,192,303 filed Dec. 2, 2004; and U.S. Pat. No. 6,962,498 filed Dec. 12, 2001 and U.S. Patent Application Publication No. 20090280673 filed Dec. 2, 2005. The contents of all of which are hereby incorporated herein by reference in their entirety.

The controls for the three motors 24, 40 and 58 can be manually controlled by switches (wall mounted or on assembly 10) or provided wirelessly via a controller and RF or other wireless setup in a known manner.

Figure 5:
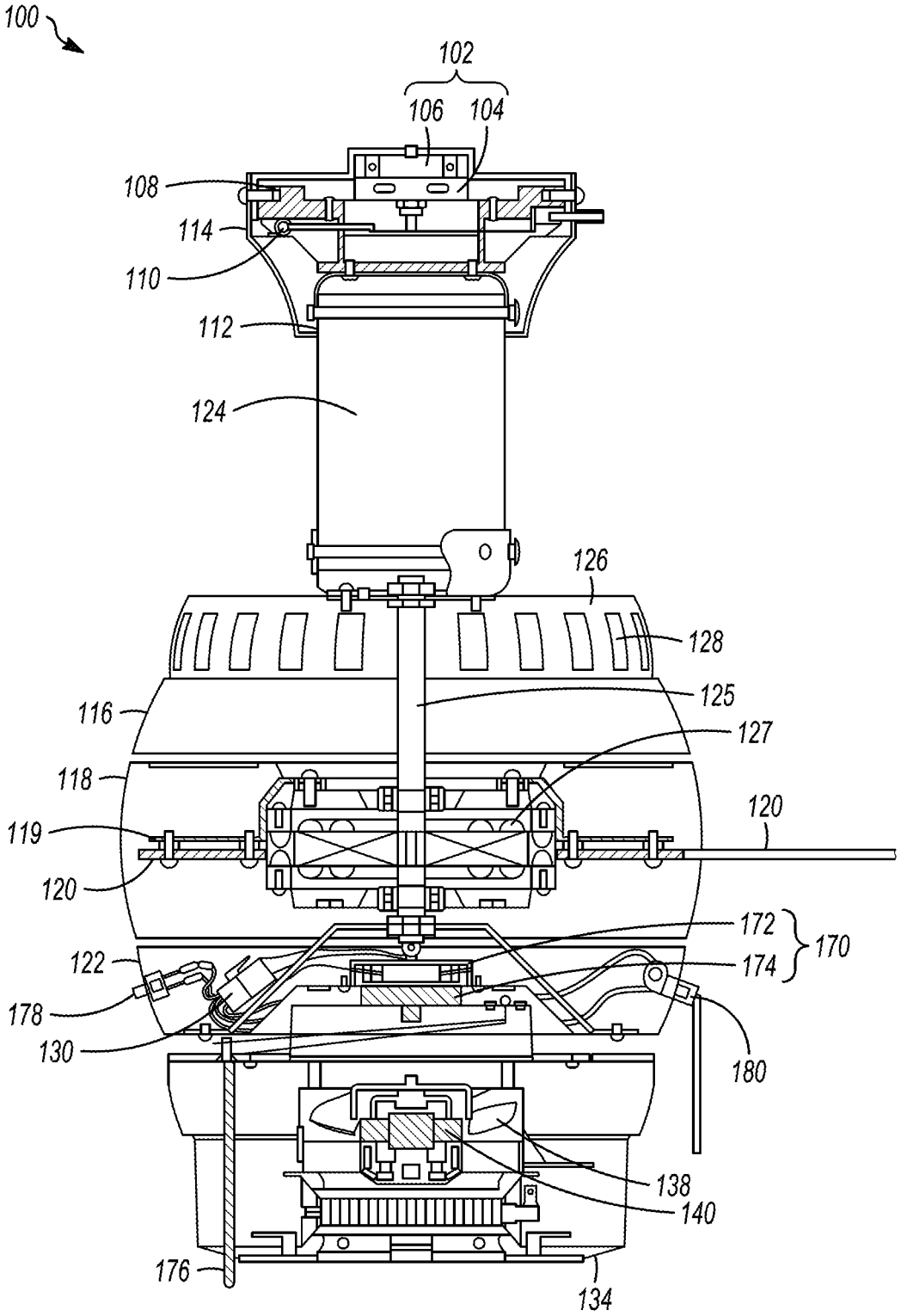
FIG. 5 shows a partially cutaway longitudinal section view structure through its mid-axial plane showing schematically the components of another embodiment of the assembly or apparatus according to the disclosure.

Another specific embodiment of the assembly or apparatus 100 according to the disclosure is shown schematically in FIG. 5. The assembly or apparatus 100 comprises a ceiling mounting portion housing 114, an upper housing portion 116, a rotating housing portion 118 from which a plurality of fan blades 120 (only two blades partially shown) extend radially outward, and a lower housing portion 122. Any suitable number of fan blades 120 can be used and the fan blades 120 can be integral to rotating housing portion 118 or attached to rotating housing portion 118 via connectors 119 so as to be replaceable. Regardless of the number of fan blades 120, the fan blades can extend substantially horizontally (i.e. parallel to a ceiling that has no angle relative to the floor) or be angled relative to the ceiling.

The various housing portions 114, 116, 118, and 122 are structurally interconnected and for aesthetics electrical wires and cables preferably extend from the top of the ceiling mounting portion 114 centrally through the various housing portions 114, 116, 118, and 122. As this structure can take many forms, it will be apparent to those skilled in the art how the interconnections are centrally made and how the wiring and cabling takes place, therefore these details are omitted for sake of clarity.

The ceiling mounting portion is intended to be mounted to a ceiling via a junction box using convention techniques or a quick attachable-detachable assembly as previously disclosed. This disclosure of the quick attachable-detachable assembly is found in U.S. Pat. No. 7,462,066 filed Mar. 20, 2007; U.S. Pat. No. 7,192,303 filed Dec. 2, 2004; and U.S. Pat. No. 6,962,498 filed Dec. 12, 2001 and U.S. Patent Application Publication No. 20090280673 filed Dec. 2, 2005. The contents of all of which are hereby incorporated herein by reference in their entirety.

As shown in FIG. 5, a quick attachable-detachable assembly 102 for installing assembly 100 comprises the combination of a plug 104 and mating socket 106. The plug 104 and mating socket 106 of the quick attachable-detachable assembly 102 function to both establish an electrical connection between assembly 100 and electrical supply wiring, and mechanically support assembly 100 on a surface, typically a ceiling. Plug 104 is fixedly secured to assembly 100 such as with coupling 108, while the socket 106 is secured to either the ceiling on which the assembly 100 is to be mounted, or to an electrical junction box.

The quick detachment of plug 104 and socket 106 can be actuated by release 110. This structure, function, and operation as well as the general structure, function, and operation of plug 104 and mating socket 106 have already been detailed in, for example, the patents and application incorporated by reference herein.

A ceiling fan motor 124 is shown schematically in FIG. 5 mounted to and partially within a lower part 112 of ceiling mounting portion housing 114. Alternatively, ceiling fan motor 124 can be mounted completely within ceiling mounting portion housing 114 and/or upper housing portion 116. Rotating housing portion 118 and output shaft 125 of ceiling fan motor 124 engage, for example, via suitable gearing 127 such as a ring gear fixed to the rotating housing portion 118, so that operation of ceiling fan motor 124 causes rotating housing portion 118 with fixed fan blades 120 to rotate, in turn causing a circular air flow to be directed downwardly. In embodiments in which ceiling fan motor 124 is reversible, the circular air flow can be directed upwardly. Rotating housing portion 118 is supported in a known manner by suitable bearing surfaces (not shown) provided by upper housing portion 116 and lower housing portion 122. A grill 126, having radial slots 128, forms the top of the upper housing portion 116. Upper housing 116 has slots (not visible in FIG. 5) peripherally spaced to enable air to enter the upper housing 116. Radial slots 128 and other slots enable air to enter for cooling of the ceiling fan motor 124 and then passage into the lower housing 122. Any combination and configuration of slots that enable sufficient air entry is contemplated by the disclosure.

A heating element such as a ceramic heater or heating coil 134 is connected to the bottom of the lower housing portion 122. Wiring 130 extending through assembly 100 is connected to power the ceramic heater 134. The connection between ceramic heater 134 and lower housing portion 122 can be made in any number of known ways, but FIG. 5 shows the connection using a quick attachable-detachable assembly 170, which comprises the combination of a plug 174 and mating socket 172. The plug 174 and mating socket 172 of the quick attachable-detachable assembly 170 function to both establish an electrical connection between ceramic heater 134 and electrical supply wiring, and mechanically couple ceramic heater 134 to lower housing portion 122. Plug 174 is fixedly secured to ceramic heater 134, while the socket 172 is secured to lower housing portion 122.

The quick detachment of plug 174 and socket 172 can be actuated by release 176. This structure, function, and operation as well as the general structure, function, and operation of plug 174 and mating socket 172 have already been detailed in, for example, the patents and application incorporated by reference herein.

As shown in FIG. 5, a heating fan 138 is driven by a heating fan motor 140, also powered by wiring 130. It should be noted that ceramic heater 134 and heating fan motor 140 can be electrically connected so that ceramic heater 134 and heating fan motor 140 can be switched on or off (which is controlled, for example by switch 178) independent of ceiling fan motor 124 (which is controlled, for example by switch 180). Alternatively, ceramic heater 134 and heating fan motor 140 can be electrically connected so that ceramic heater 134 and heating fan motor 140 can be switched on (or off) only when ceiling fan motor 124 is running.

In operation, the ceramic heater 134 heats air and is blown over the ceramic heater 134 by the heating fan 138. Like the air flow output of the blades 120, the heated air flow output by the ceramic heater 134 is directed downwardly. When both the ceiling fan blades 120 and ceramic heater 134 are functioning, the heated air from the ceramic heater flows downwardly conically expanding outwardly due to diffusion and mixes with the flow of air from the ceiling fan blades 120. When the mixed flow reached the floor of the room in which the ceiling fan is mounted, the air flow spreads outwardly until it encounters the walls whereupon it will rise upwardly toward the ceiling.

The disclosure also contemplates that the assembly of FIG. 5 can have the lighting effect discussed above with reference to FIGS. 1-4. The controls for motors 124, 140 and a reflective foil spin motor, if so provided, can be manually controlled by switches (wall mounted or on assembly 100) or provided wirelessly via a controller and RF or other wireless setup in a known manner.

All references cited herein are expressly incorporated by reference in their entirety. It will be appreciated by persons skilled in the art that the present disclosure is not limited to what has been particularly shown and described herein above. In addition, unless mention was made above to the contrary, it should be noted that all of the accompanying drawings are not to scale. There are many different features to the present disclosure and it is contemplated that these features may be used together or separately. Thus, the disclosure should not be limited to any particular combination of features or to a particular application of the disclosure. Further, it should be understood that variations and modifications within the spirit and scope of the disclosure might occur to those skilled in the art to which the disclosure pertains. Accordingly, all expedient modifications readily attainable by one versed in the art from the disclosure set forth herein that are within the scope and spirit of the present disclosure are to be included as further embodiments of the present disclosure.

What is claimed is:

1. An apparatus for providing air circulation, in a room environment and for distributing heated air to the room environment, the apparatus comprising:

a ceiling fan assembly having a main housing, the main housing including a ceiling mounting portion, an upper housing portion, a rotating housing portion, and a lower housing portion, wherein the ceiling mounting portion, the upper housing portion, the rotating housing portion, and the lower housing portion are structurally interconnected internally within the main housing;

a plurality of fan blades extending in a horizontal plane from the rotating housing portion, the plurality of fan blades configured and arranged for producing downward air flow;

electrical wires extending centrally from a top of the ceiling mounting portion through the main housing;

a ceiling fan motor configured for rotating the rotating housing portion;

a heater configured for heating air, the heater having a pre-selected shape and mounted at a bottom of the lower housing portion such that the plurality of fan blades is positioned above the heater;

a skirt enclosing the heater and extending above the heater thereby creating and air tunnel to direct air toward the heater;

a plurality of reflective foils mounted for rotation in the lower housing portion;

a translucent band surrounding the lower housing portion, the translucent band having a substantially cylindrical shape and positioned in a horizontal plane between the plurality of fan blades and the heater; and a heating fan driven by a heating fan motor mounted within the lower housing portion, the heating fan configured for passing air through the air tunnel over the heater;

wherein heated air output from the heater flows downwardly and conically expands outwardly mixing with the downward air flow produced by the plurality of fan blades, thereby providing air circulation to the room environment and distributing heated air to the room environment; and wherein the translucent band has a face with axially colored striping such that light reflected from the plurality of reflective foils passes through the axially colored striping of the face of the translucent band such that the light has a flickering appearance.

2. The apparatus according to claim 1, wherein the plurality of fan blades is detachably connected to the rotating housing portion.

3. The apparatus according to claim 1, wherein the heater and the heating fan motor are configured to be operable only when the ceiling fan motor is operating.

4. The apparatus according to claim 1, wherein the heater is a ceramic heater.

5. The apparatus according to claim 4, wherein the ceramic heater produces the light reflected from the plurality of reflective foils and passing through the axially colored striping on the face of the translucent band.

6. The apparatus according to claim 1, further comprising a spin motor configured for rotating the plurality of reflective foils.

7. The apparatus according to claim 6, further comprising a plurality of spokes corresponding to the plurality of reflective foils, each reflective foil of the plurality of reflective foils extending from the spin motor on each spoke of the plurality of spokes.

8. The apparatus according to claim 1, further comprising lighting elements mounted with the plurality of reflective foils, the lighting elements configured and arranged for shining light through the translucent band.

9. The apparatus according to claim 8, wherein the lighting elements are light-emitting diodes (LEDs).

10. The apparatus according to claim 7, further comprising a quick attachable-detachable device having a plug and a mating socket, wherein the plug is secured to the ceiling mounting portion.

11. The apparatus according to claim 7, further comprising a quick attachable-detachable device having a plug and a mating socket, wherein the plug is secured to the heater and the mating socket is secured to the bottom of the lower housing portion.

12. An apparatus for providing air circulation in a room environment and for distributing heated air to the room environment, the apparatus comprising:

a ceiling fan assembly having a main housing, the main housing including a ceiling mounting portion, an upper housing portion, a rotating housing portion, and a lower housing portion, wherein the ceiling mounting portion, the upper housing portion, the rotating housing portion, and the lower housing portion are structurally interconnected internally within the main housing;

a plurality of fan blades extending in a horizontal plane from the rotating housing portion, the plurality of fan blades configured and arranged for producing downward air flow;

electrical wires extending centrally from a top of the ceiling mounting portion through the main housing;

a ceiling fan motor configured for rotating the rotating housing portion;

a heater configured for heating air, the heater having a pre-selected shape and mounted at a bottom of the lower housing portion such that the plurality of fan blades is positioned above the heater;

a skirt enclosing the heater and extending above the heater thereby creating and air tunnel to direct air toward the heater;

a translucent band surrounding the lower housing portion, the translucent band having a cylindrical shape and positioned in a horizontal plane between the plurality of fan blades and the heater;

a plurality of reflective foils mounted in the lower housing portion, the plurality of reflective foils configured and arranged for rotation;

a plurality of lighting elements mounted with the plurality of reflective foils, the plurality of lighting elements configured and arranged for shining light at the plurality of rotating reflective foils and through axially colored striping on a face of the translucent band thereby creating a motion effect in the shining light; and a heating fan driven by a heating fan motor mounted within the lower housing portion, the heating fan configured for passing air through the air tunnel over the heater;

wherein heated air output from the heater flows downwardly and conically expands outwardly mixing with the downward air flow produced by the plurality of fan blades, thereby providing air circulation to the room environment and distributing heated air to the room environment.

13. The apparatus according to claim 12, wherein the lighting elements are light-emitting diodes (LEDs).

14. The apparatus according to claim 12, wherein the plurality of fan blades is detachably connected to the rotating housing portion.

15. The apparatus according to claim 12, wherein the heater and the heating fan motor are configured to be operable only when the ceiling fan motor is operating.

16. The apparatus according to claim 12, wherein the heater is a ceramic heater.

17. The apparatus according to claim 12, further comprising a spin motor configured for rotating the plurality of reflective foils.

18. The apparatus according to claim 17, further comprising a plurality of spokes corresponding to the plurality of reflective foils, each reflective foil of the plurality of reflective foils extending from the spin motor on each spoke of the plurality of spokes.

19. The apparatus according to claim 18, further comprising a quick attachable-detachable device having a plug and a mating socket, wherein the plug is secured to the ceiling mounting portion.

20. The apparatus according to claim 18, further comprising a quick attachable-detachable device having a plug and a mating socket, wherein the plug is secured to the heater and the mating socket is secured to the bottom of the lower housing portion.

* * * * *